US005682576A

United States Patent [19]

Sakai et al.

[11] Patent Number: 5,682,576

[45] Date of Patent: Oct. 28, 1997

[54] FIXING DEVICE

[75] Inventors: Hiroaki Sakai; Masaharu Ohkubo, both of Yokohama; Norio Hashimoto, Tokyo; Takayasu Yuminamochi; Hiroto Hasegawa, both of Kawasaki; Kazuaki Ono, Tokyo; Minoru Matsuguma, Kawasaki; Yasunari Kobaru, Yokohama, all of Japan

[73] Assignee: Canon Kabushiki Kaisha, Tokyo, Japan

[21] Appl. No.: 483,864

[22] Filed: Jun. 7, 1995

[30] Foreign Application Priority Data

Jun. 7, 1994 [JP] Japan ..... 6-147018
Dec. 28, 1994 [JP] Japan ..... 6-328014

[51] Int. Cl.[6] ..... H05B 1/02; G03G 15/20

[52] U.S. Cl. ..... 399/69; 399/33; 219/216

[58] Field of Search ..... 355/208, 285, 355/282; 432/60; 219/216

[56] References Cited

U.S. PATENT DOCUMENTS 4,719,489 1/1988 Ohkubo et al. ..... 355/3 FU
5,303,016 4/1994 Oda et al. ..... 355/289
5,365,314 11/1994 Okuda et al. ..... 355/208
5,465,141 11/1995 Asano et al. ..... 355/285

FOREIGN PATENT DOCUMENTS 63-313182 12/1988 Japan .
02157878 6/1990 Japan .
04044075 2/1992 Japan .
04044076 2/1992 Japan .
04044077 2/1992 Japan .
04044078 2/1992 Japan .
04044079 2/1992 Japan .
04044080 2/1992 Japan .
04044081 2/1992 Japan .
04044082 2/1992 Japan .
04044083 2/1992 Japan .

OTHER PUBLICATIONS

*Patent Abstracts of Japan*, vol. 8, No. 169(P292), Aug. 4, 1984, JP5962923, Apr. 10, 1984.

*Primary Examiner*—R. L. Moses
*Attorney, Agent, or Firm*—Fitzpatrick, Cella, Harper & Scinto

[57] ABSTRACT

In a fixing device used in an image forming apparatus, temperature changes in a heating member are reduced by gradually reducing a power supply duty ratio while the heating member is subjected to temperature control aiming at a set temperature.

9 Claims, 19 Drawing Sheets

FIG.19

| HEATER ON/OFF STEP | LIGHTING TIME PERIOD OF HEATER WITHIN UNIT |
|---|---|
| 5 | 500msec |
| 4 | 400msec |
| 3 | 300msec |
| 2 | 200msec |
| 1 | 100msec |

FIXING DEVICE

BACKGROUND OF THE INVENTION

1. Field of the Invention

This invention relates to a fixing device used in an image forming apparatus, such as a copier, a printer, or the like.

2. Description of the Related Art

A fixing device is used in an image forming apparatus, in which a toner image, serving as an unfixed image, is transferred onto a recording material, and a permanent image is obtained by fixing the toner image by heating, has, for example, the configuration shown in FIG. 10. In FIG. 10, a fixing roller 1, serving as recording-material conveying means, comprises a releasing resin layer 12, made of PFA (phenol-formaldehyde resin), PTFE (polytetrafluoroethylene resin), or the like provided on a core bar 11 made of aluminum, iron, or the like. The inside of the fixing roller 1 is heated by a heater 4, serving as heating means.

A pressing roller 2, serving as another recording-material conveying means, rotates with the fixing roller 1 in pressure contact therewith. Pressing roller 2 comprises an elastic layer 14 made of a silicone rubber, a silicone sponge, or the like having a high temperature-resistive property and a low hardness provided on a metallic core bar 13, made of aluminum, iron, or the like. A coated layer 15, made of a resin and having a high releasability, such as PFA, PTFE, or the like is formed on the surface of the elastic layer 14.

A temperature detection element 3 for detecting the surface temperature of the fixing roller 1 is disposed so as to contact the surface of the fixing roller 1. In a fixing device having cleaning means, such a temperature detection element 3 can be provided within a region where paper passes. However, as shown in FIG. 10, in the fixing device not having cleaning means, the temperature detection element 3 is provided in a region where paper does not pass in order to prevent contamination in the obtained image.

An entrance guide 6 is disposed in front of the fixing roller 1 and the pressing roller 2. A recording material P carrying a toner image is guided to a nip portion between the fixing roller 1 and the pressing roller 2 by the entrance guide 6, and the toner image is fixed by being heated and pressed.

As described above, by grasping and conveying the recording material P while heating it at the nip portion, an excellent fixing operation can be performed. However, there is a possibility of producing creases in the recording material P. In order to overcome such a problem, there has been a general practice of providing the fixing roller 1 and the pressing roller 2 with an appropriate inverse-crown shape in the longitudinal direction thereof to optimize the position of entrance of the recording material P in the fixing nip portion.

In order to fix the toner image in an excellent state, it is important to maintain the temperature of the fixing roller 1 at an appropriate temperature as well as to press the recording material P. Conventionally, the surface temperature of the fixing roller 1 is controlled at a predetermined temperature in detecting it by the temperature detection element 3 of the temperature of the fixing roller 1 and intermittently operating the heater 4 by a temperature control circuit (shown in FIG. 12), serving as temperature control means. In this case, as shown in FIG. 11, a heating period in which the heater 4 is on if the detected temperature is lower than a target temperature, and a non-heating period in which the heater 4 is off it the detected temperature is higher than the target temperature are provided, so that the surface temperature of the fixing roller 1 is maintained at temperatures in the vicinity of the target temperature. In FIG. 11, the heater 4 is turned on when the surface temperature of the fixing roller 4 is more or less lower than the target temperature, and the heater 4 is turned off when the surface temperature of the fixing roller 4 is more or less higher than the target temperature. This is because there is a delay in response of the temperature detection element 3.

However, in the above-described conventional approach of current supply control, there are such problems that, for example, when turning on and off the heater, the picture of a computer display connected on the same power-supply line as the heater becomes distorted, and the light intensity of illuminating devices temporarily decreases. This is due to a temporary voltage drop in the power-supply line because a current whose value is 3–4 times an ordinary value flows as a rush current when the heater is turned on. The value of this rush current is greater as the temperature of the current flowing portion of the heater is lower (as the resistance value of the heater is lower), and as the rated power (the rated current) of the heater is greater. Counter-measures for such problems using an electric circuit require a large space, thereby increasing the size and the cost of the apparatus.

Recently, there is a tendency to reduce the heat capacity of the fixing roller in order to shorten the rise time of the fixing device. Accordingly, when applying the above-described heater driving method to control temperature of a thin fixing roller having a small heat capacity, abrupt temperature changes occur in the fixing roller as a result of turning on/off the heater, thereby causing variations in fixability of the fixing roller. Particularly in high-speed apparatuses, since a high-power heater is used and the amount of heat transfer to a recording material, such as paper or the like, is great, the speed of temperature rise when the heater is turned on and the speed of temperature fall when the heater is turned off increases. Hence, it is difficult to reduce temperature changes in the fixing roller in the above-described conventional on/off control.

When performing the above-described temperature control in a fixing device having a small heat capacity, a failure in fixing sometimes occurs depending on the specifications of the apparatus. For example, when the conventional heater control shown in FIG. 11 is performed for an image forming apparatus having a printing speed of 150 mm/sec, about two sheets of a recording material pass through the fixing nip in the case of feeding A4-size sheets in the lateral direction and in the case of feeding A3-size sheets in the longitudinal direction one sheet passes while the heater is turned off (2–3 seconds) in a continuous fixing operation. Since thermal energy is not supplied to the fixing roller during that time period due to a delay in response of the temperature detection element, fixability of the fixing roller degrades for the second A4-size sheet and for the latter half of the A3-size sheet after the heater has been turned off.

A detailed explanation will now be provided of such problems. In a thin fixing roller having a small heat capacity, since the heat quantity necessary for fixing can be maintained only during a single revolution of the fixing roller, a method for replenishing thermal energy is a problem. That is, when the time period in which the heater is off is longer than the time period of one revolution of the fixing roller, a failure in fixing due to insufficient heat quantity occurs after the second revolution of the fixing roller. For example, when performing printing on A3-size paper using a fixing roller having an outer diameter of 30 mm, the fixing roller performs 4.45 revolutions in contact with the paper. When the printing speed is 150 mm/sec and the on-off period of the heater is about 2 seconds, almost an entire portion of the paper passes through the fixing nip when the heater is off. At that time, the fixing roller performs at least three revolutions, and the surface temperature of the fixing roller decreases by 10°–15° C. Hence, a failure in fixing occurs after the second revolution of the fixing roller.

SUMMARY OF THE INVENTION

The present invention has been made in consideration of the above-described problems.

It is an object of the present invention to provide a fixing device capable of reducing a rush current without increasing the size of the entire apparatus.

It is another object of the present invention to provide a fixing device capable of reducing temperature ripples even if a fixing roller having a small heat capacity is used.

It is still another object of the present invention to provide a fixing device in which a failure in fixing does not occur even if a fixing roller having a small heat capacity is used.

According to one aspect, the present invention, which achieves these objectives, relates to a fixing device comprising a heating member, temperature detection means for detecting a temperature of the heating member, and power supply control means for controlling power supply to the heating member so that the temperature detected by the temperature detection means is maintained at a set temperature. The power supply control means gradually reduces a power supply duty ratio while temperature control aiming at the set temperature is performed.

According to another aspect, the present invention relates to a fixing device comprising a heating rotating member, temperature detection means for detecting a temperature of the heating rotating member, and power supply control means for controlling power supply to the heating rotating member so that the temperature detected by the temperature detection means is maintained at a set temperature. The power supply control means controls the power supply such that a maximum power-supply-off time period is equal to or less than a time period required for one revolution of the heating rotating member.

The foregoing and other objects, advantages and features of the present invention will become more apparent from the following detailed description of the preferred embodiments taken in conjuction with the accompanying drawings.

BRIEF DESCRIPTION OF THE DRAWINGS

FIG. 19 is a diagram illustrating lighting time periods of a heater.

DETAILED DESCRIPTION OF THE PREFERRED EMBODIMENTS

Preferred embodiments of the present invention will now be described with reference to the drawings.

First Embodiment

Figure 1:
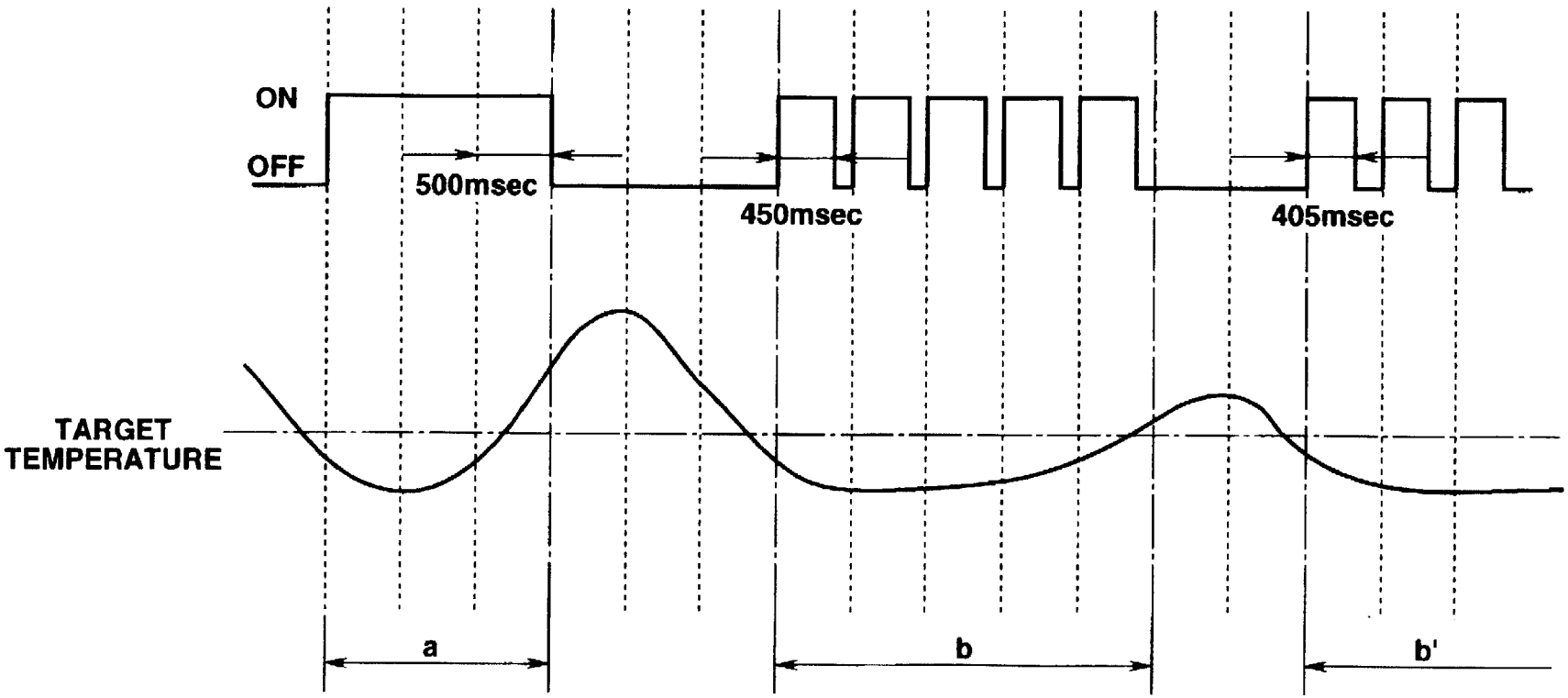
FIG. 1 is a diagram illustrating a lighting state of a heater and temperature changes in a fixing roller in temperature control according to a first embodiment of the present invention.
Figure 2:
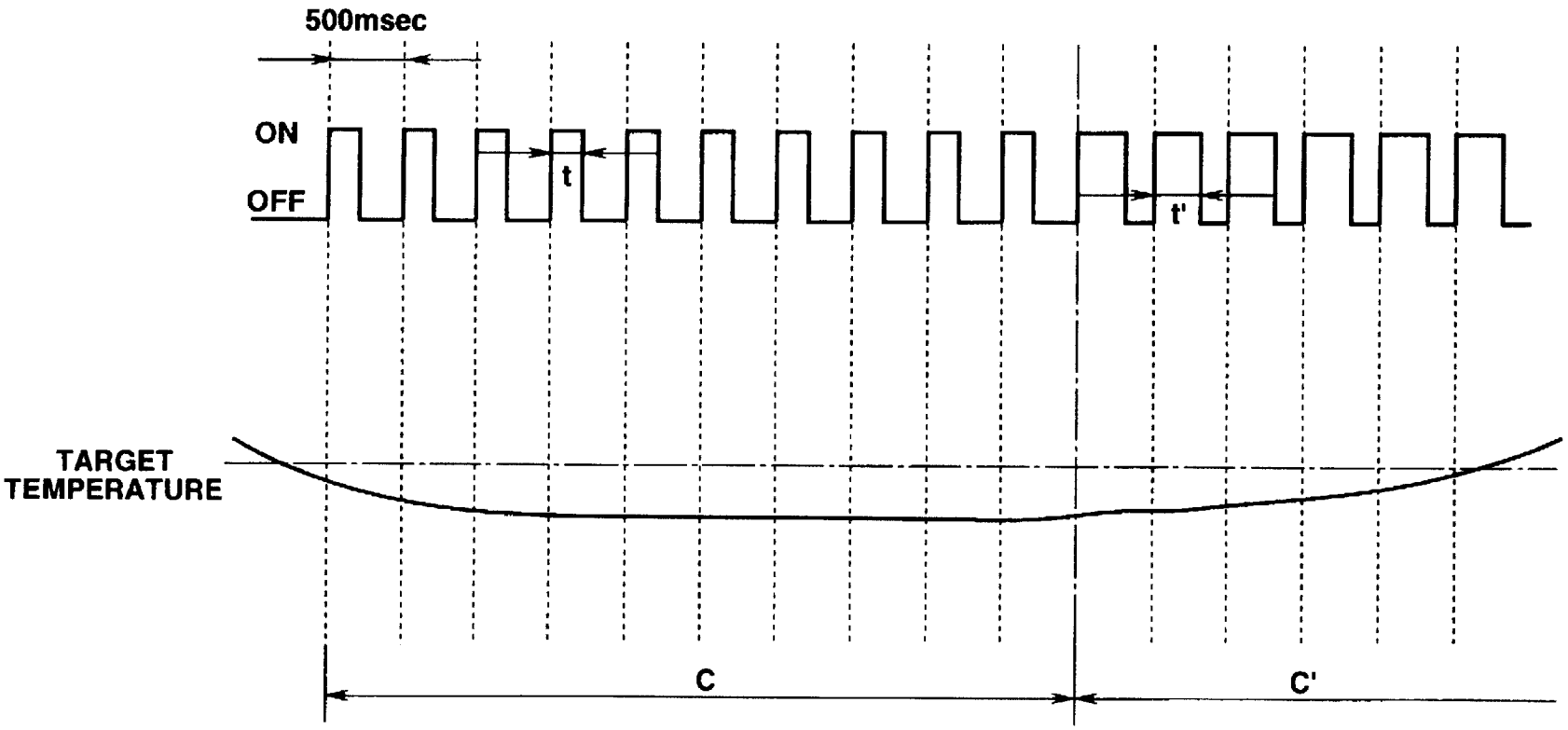
FIG. 2 is a diagram illustrating a case in which the temperature of a fixing roller does not reach a target temperature within a predetermined time period during a heating period.

First, a description will be provided of a first embodiment of the present invention with reference to FIGS. 1 and 2. The configuration and external appearance of a fixing device according to the first embodiment is the same as in the conventional fixing device shown in FIG. 10. Hence, the same description thereof as in the case of the device shown in FIG. 10 will be omitted.

In this fixing device, paper is used as a recording material, and the maximum passable size of paper is the width of A3-size paper (297 mm). Center reference is adopted in which the center of a fixing roller (heating member) 1, serving as recording material conveying means, is made to be a reference position for the passage of paper. Luminous intensity distribution of a heater 4 incorporated within the fixing roller 1 is symmetrical with respect to the reference position for the passage of paper. A halogen-lamp heater is used as the heater 4. The rated power of the heater 4 is 500 W.

The fixing roller 1 has a diameter of 40 mm and a thickness of 2.0 mm, and comprises a core bar 11, made of aluminum, coated with a releasing layer 12, made of PFA, on the surface thereof. A pressing roller 2, serving as another recording material conveying means, has a diameter of 30 mm and a hardness of 50° (Asker-C), and comprises a stainless-steel core bar 13 coated with an elastic layer 14, made of a silicone sponge, and also coated with a releasing layer 15, made of PFA, on the surface of the elastic layer 14. By applying a pressure of 150 N to the pressing roller 2, a nip width of 5.5 mm can be provided between the fixing roller 1 and the pressing roller 2.

As shown in FIG. 1, in heater driving control when peforming printing using this fixing device, on/off of the heater is consecutively repeated by making a time period, for example, 500 msec, which is smaller than time periods of heating until the surface temperature of the fixing roller 1 exceeds a target temperature (regions a, b and b'), for one period. By increasing or decreasing the on-time of the heater within the one period 500 msec in accordance with the value of the heating time period, the surface temperature of the fixing roller is maintained at the target temperature while reducing variations in the temperature of the heating portion of the heater.

An example of such control will now be described. When printing is started in ordinary on/off control, the on-time is made equal to the one period 500 msec (i.e., a duty ratio of 100%) until the temperature of the fixing roller 1 exceeds the target temperature after starting power supply (region a). When the temperature of the fixing roller 1 exceeds the target temperature, the heater is turned off and the off-state is maintained until the temperature of the fixing roller 1 becomes equal to or less than the target temperature. When the temperature of the fixing roller 1 becomes equal to or less than the target temperature, on/off of the heater is repeated while reducing the ratio of the on-time of the heater within the one period 500 msec by a predetermined ratio (10% in this embodiment) (region b). In this state, the electric power of the heater is reduced by 10% compared with the case in which the on-time equals the entire period, and therefore the speed of temperature rise in the fixing roller decreases. That is, by gradually reducing the duty ratio of power supply, a state in which supplied power is smaller than power consumption necessary to maintain a constant temperature is provided at a certain stage. In this state, the temperature of the fixing roller continues to decrease even if power is supplied with the period of 500 msec. For example, as indicated by region c shown in FIG. 2, when the temperature of the fixing roller does not reach the target temperature or continues to decrease even if on/off of the heater is repeated for at least a predetermined number of periods (10 periods in this embodiment), it is intended to recover the temperature of the fixing roller by increasing the on-time within one period by 5% (region c' in which t'=1.05t).

As described above, in a consecutive printing operation, when increasing the temperature of the heating member (fixing roller) toward the fixing temperature (warming-up), the ratio of power supply is made to equal one period of 500 msec, and subsequent temperature control is performed by adjusting the on-time within the heater driving period. That is, when the temperature of the fixing roller increases and exceeds the target temperature while on/off of the heater having the period of 500 msec is continuously peformed, the ratio of the on-time of the heater within one period is reduced by 10% (region b and region b' shown in FIG. 1). When the temperature of the fixing roller does not reach the target temperature even if on/off of the heater is repeated for 10 periods (region c shown in FIG. 2), the duty ratio of power supply is increased at a ratio smaller than the ratio of reduction of power supply. In the present embodiment, the ratio of the on-time within one period is increased by 5% (region c' shown in FIG. 2).

Although in this embodiment the on/off period of the heater is set to 500 msec, it is possible to select an optimum value depending on the printing speed, the outer diameter and the thickness of the fixing roller, and the rated power of the heater. In order to increase the temperature of the heating portion of the heater to an appropriate value (a temperature where a halogen cycle is satisfied in the case of a halogen-lamp heater), the on-state must be at least 100 msec. Since an off-time equal to or greater than 1 second will cause a decrease in the temperature of the current-passing portion of the heater and therefore the value of a rush current cannot be reduced, it is desirable to set the off-time equal to or less than 1 second. Although in the present embodiment the on-time of the heater is reduced by 10% and increased by 5%, and the time required for determining increase of the duty ratio is set to 10 periods, any other optimum value may, of course, be selected depending on the configuration of the fixing device and the printing speed.

Second Embodiment

Next, a description will be provided of a second embodiment of the present invention with reference to FIGS. 3 through 9. In FIGS. 3 through 9, the same components as in the first embodiments are indicated by the same reference numerals, and a description thereof will be omitted.

In the present embodiment, a low-heat-capacity-type roller having a thickness equal to or less than 1 mm is used as the fixing roller. When using such a roller, the temperature of the fixing roller greatly changes by on/off of the heater in addition to the problem of a rush current, and problems such as unevenness in fixability and the like arise. Particularly in this case, it is requested to stabilize fluctuations in the power of the heater. However, in the case of a low-heat-capacity-type roller, it is difficult in some cases to provide a state in which on/off of the heater can be repeated with a predetermined period even if the above-described control is performed.

Figure 3:
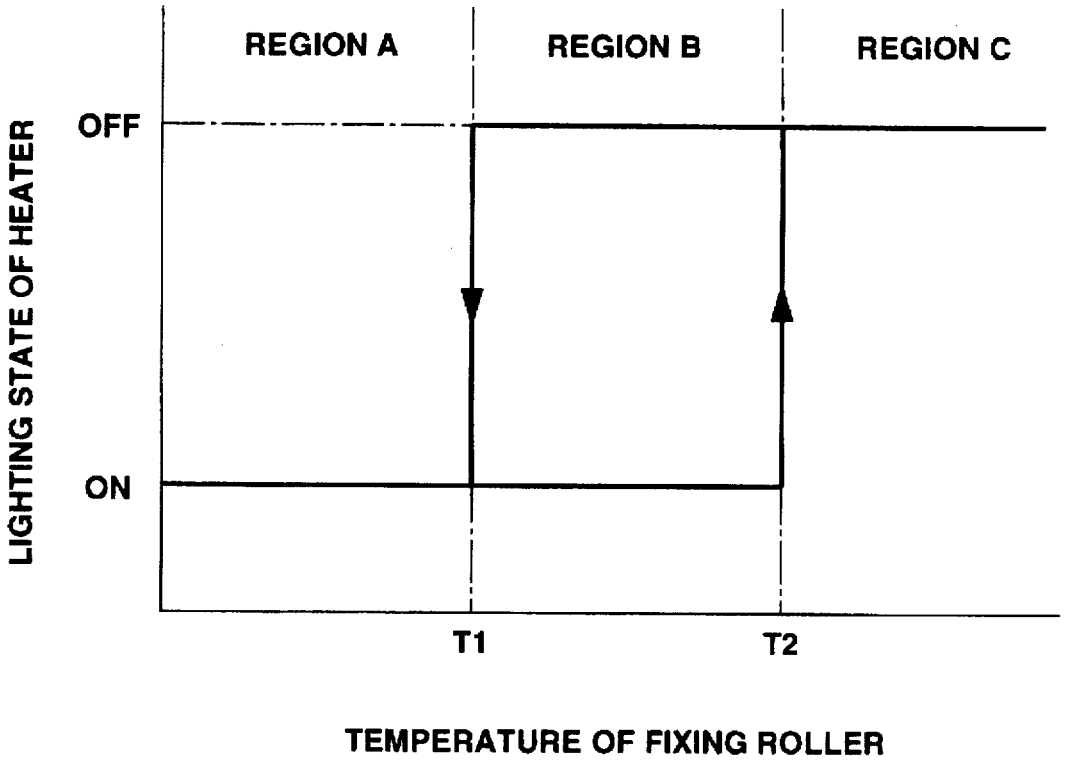
FIG. 3 is a diagram illustrating an on/off state of a heater when performing temperature control by providing hysteresis according to a second embodiment of the present invention.

Accordingly, in order to be able to consecutively repeat on/off of the heater with a predetermined period even in the case of large temperature changes, as shown in FIG. 3, hysteresis is provided for temperatures set for the heater. In this approach, the on-time of the heater in one period is reduced when the temperature of the fixing roller becomes a high temperature T2, and is increased when the temperature of the fixing roller becomes a low temperature T1, so that the fixing temperature is confined within a temperature range between T1–T2.

After starting printing, first, as in the above-described case, temperature control is performed only with the set temperature T1. When the temperature of the fixing roller does not exceed T1 even by repeating on/off of the heater for at least 10 periods, hysteresis control is started as well as an increase of the on-time by 5%. In this control, when the temperature of the fixing roller enters from region B into region C, shown in FIG. 3, passing through T2, the heater is turned off. When the temperature of the fixing roller enters from region B into region A passing through T1, the heater is subjected to on/off drive with the period of 500 msec while reducing the on-time by 10%. When the temperature of the fixing roller does not enter region B within 10 periods after entering region A, the on-time is increased by 5%.

This control differs from the above-described control in that the preceding state (the on-time of the heater within the heater-driving period) is continued while the temperature of the fixing roller is within region B. Thus, even in the case of large temperature changes, it is possible to rapidly converge the value of the changes, and to prevent distortion of display and flickering of illuminating devices due to a rush current.

Figure 4:
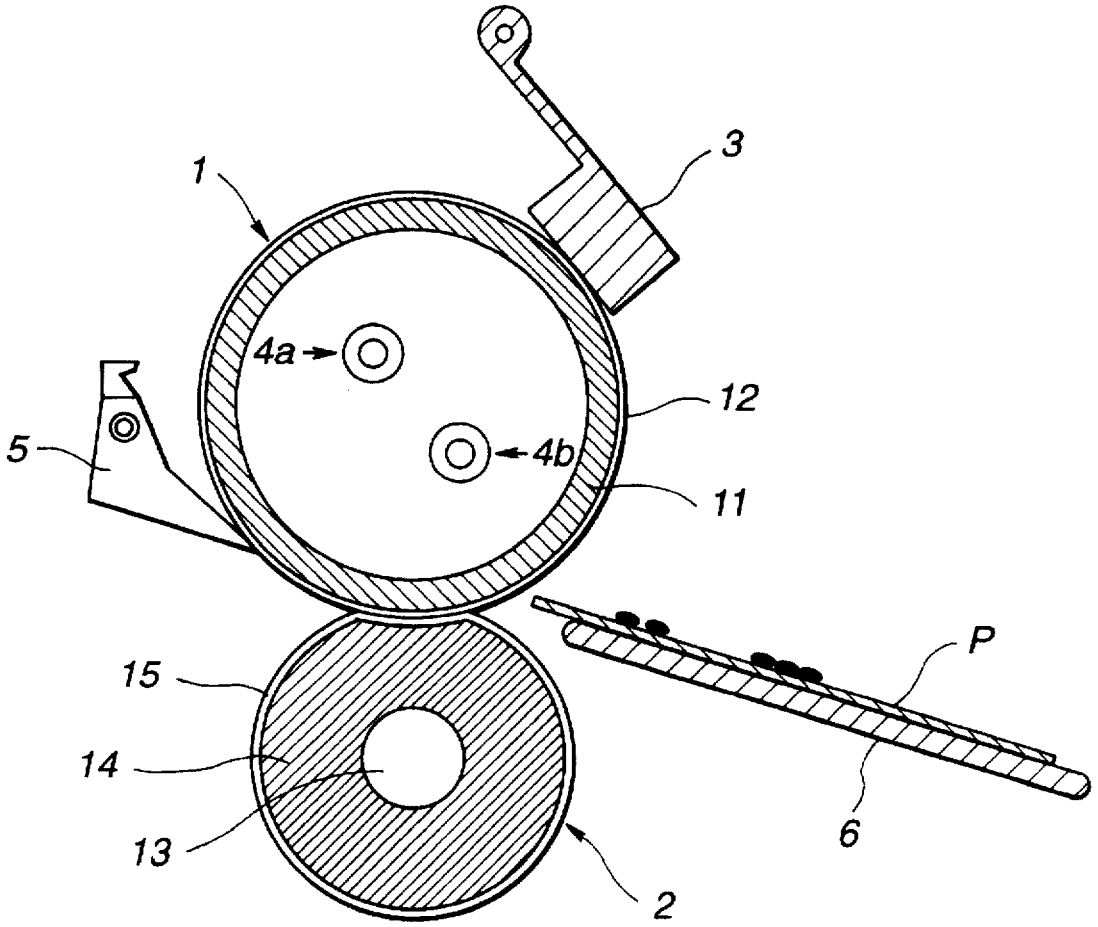
FIG. 4 is a cross-sectional view of a fixing device using two heaters in the second embodiment.
Figure 5:
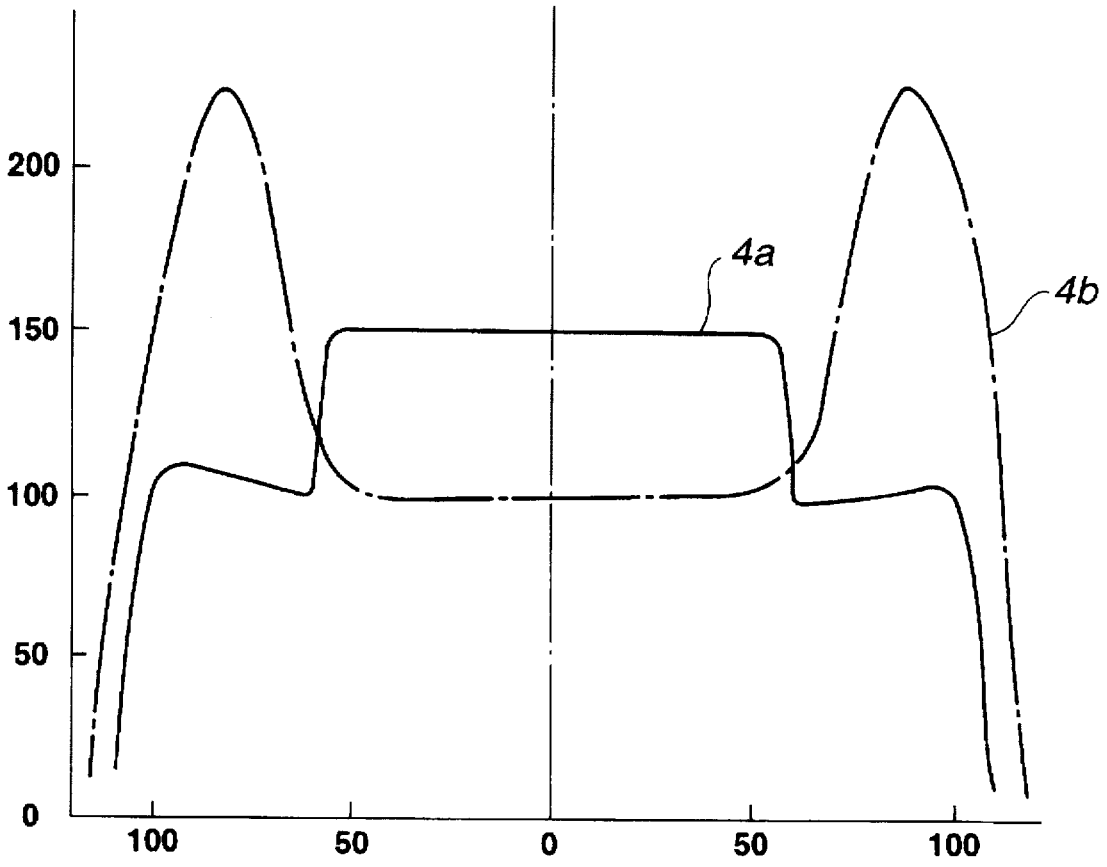
FIG. 5 is a graph illustrating luminous intensity distribution characteristics of the two heaters shown in FIG. 4.
Figure 10:
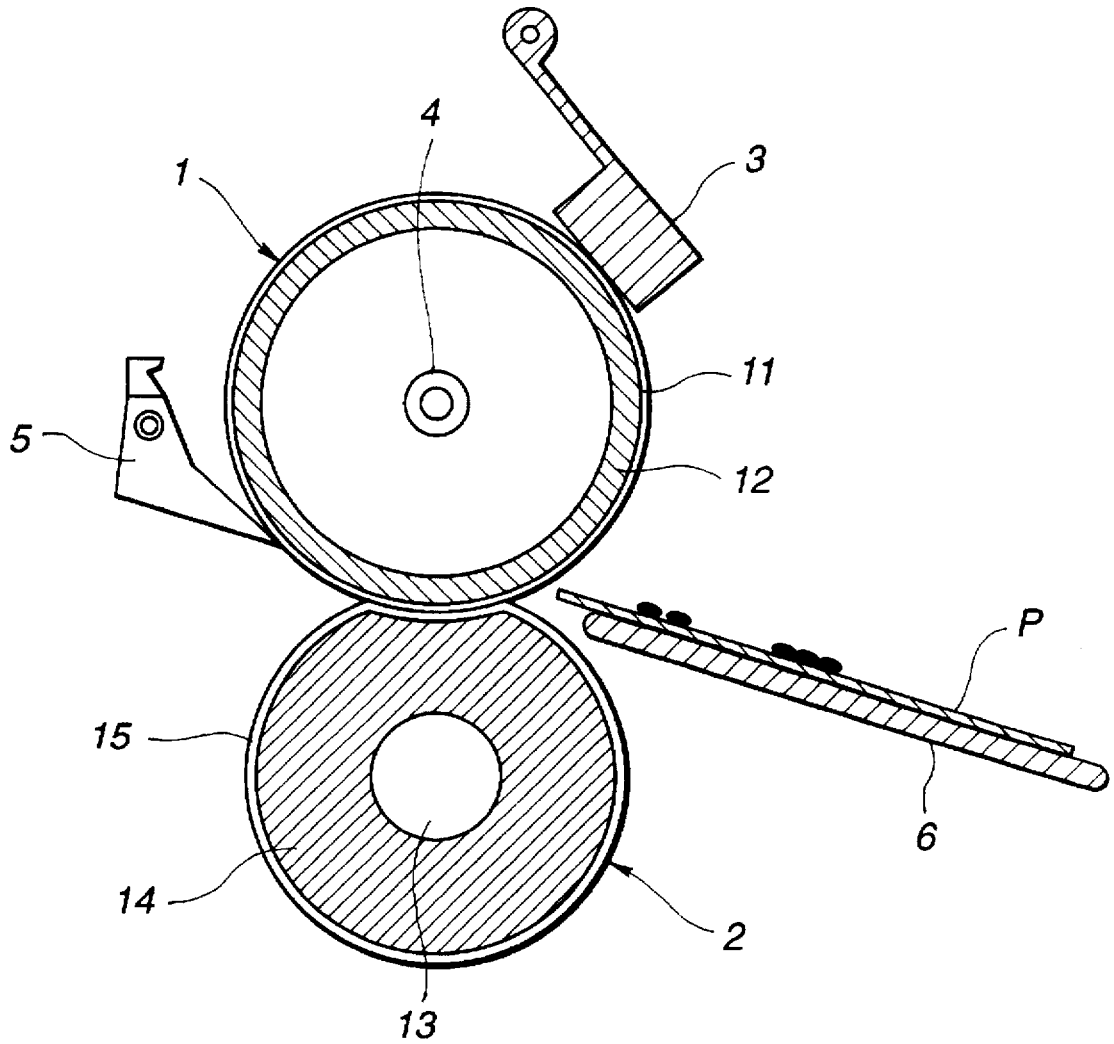
FIG. 10 is a cross-sectional view of a conventional fixing device.
Figure 11:
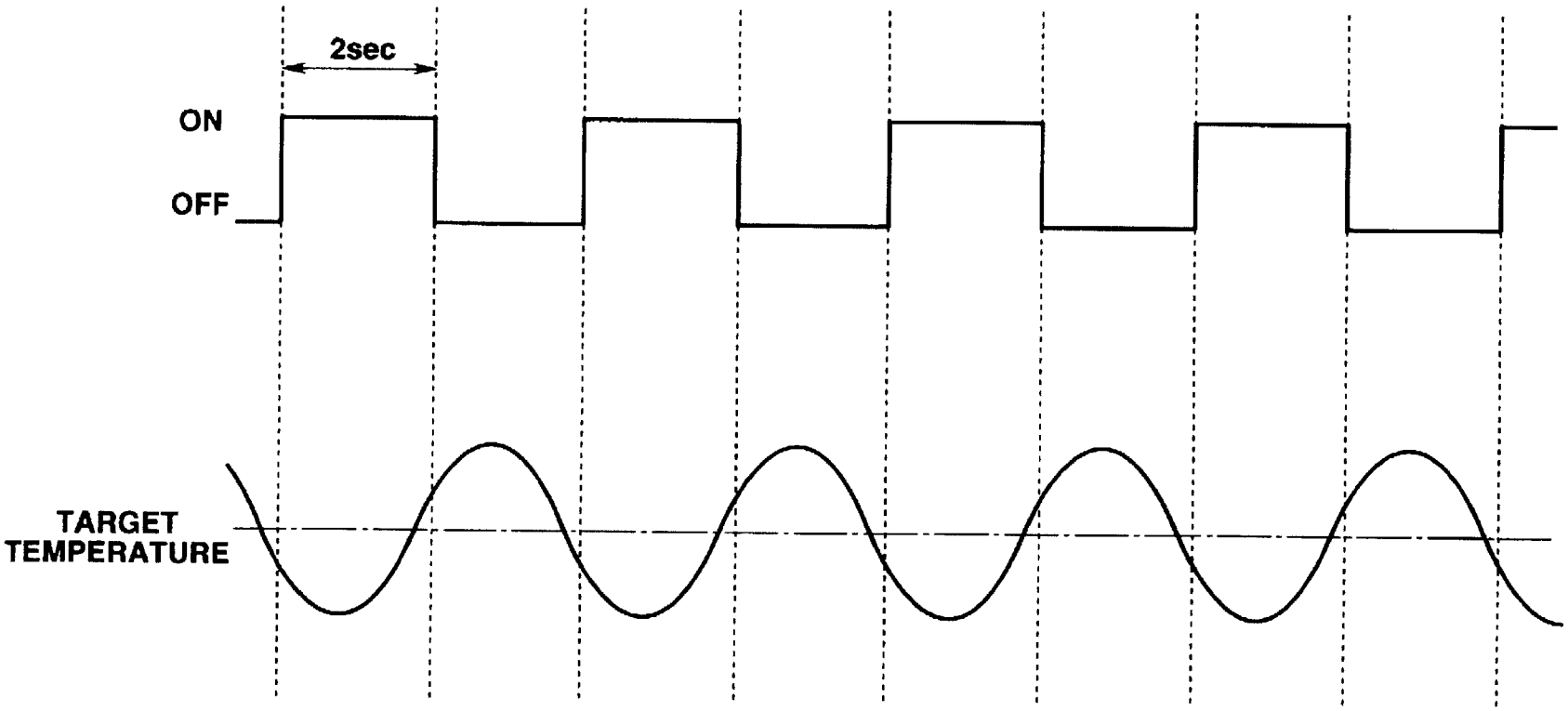
FIG. 11 is a diagram illustrating a lighting state of a heater and temperature changes in a fixing roller in the conventional fixing device.
Figure 12:
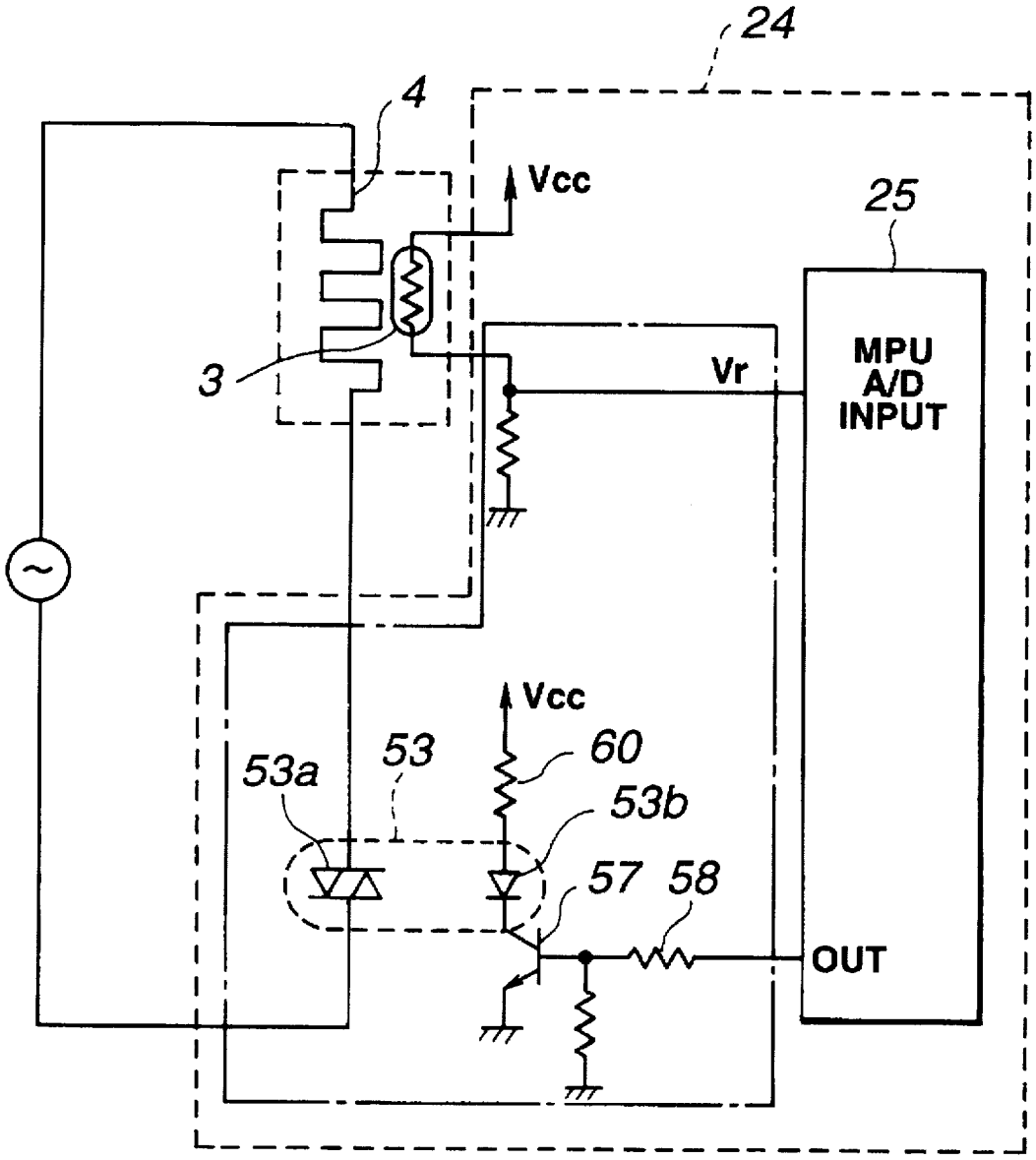
FIG. 12 is a diagram illustrating a temperature control circuit, serving as temperature control means, used for the conventional fixing device.

A description will now be provided of an example of application of this hysteresis temperature control to a device having two heaters. In this example, two heaters having powers of 500 W and 400 W are used, and conditions for a rush current are the same as in the above-described case. The two heaters have different luminous intensity distributions. FIG. 4 is a cross-sectional view of the fixing device, and FIG. 5 illustrates luminous intensity distributions of the heaters. In FIG. 4, the same components as those shown in FIG. 10 are indicated by the same reference numerals, and an explanation thereof will be omitted. A thin fixing roller having a thickness of 0.85 mm is used. Reference numeral 4*a* represents a main heater having a power of 500 W, and reference numeral 4*b* represents a sub-heater having a power of 400 W.

Figure 6:
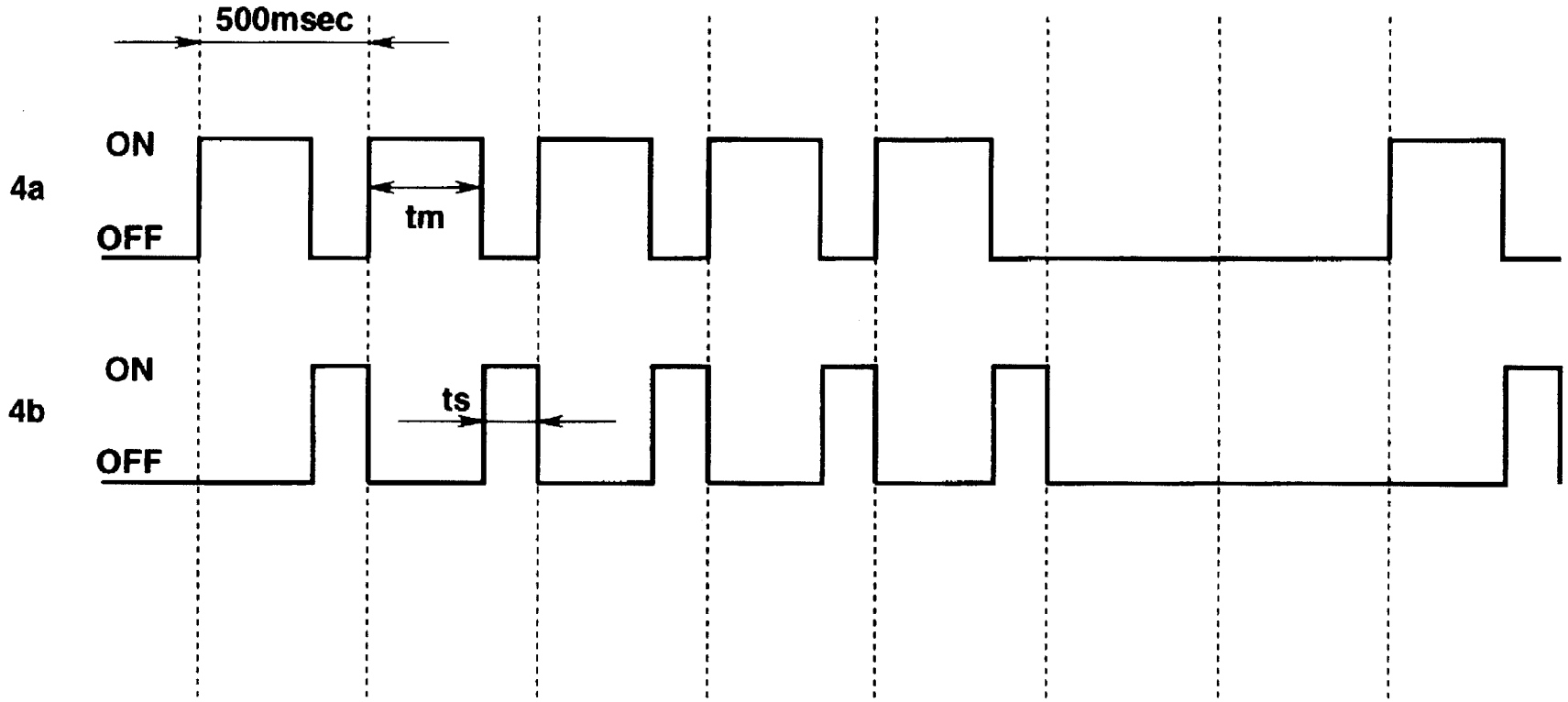
FIG. 6 is a diagram illustrating lighting timings of the two heaters shown in FIG. 4.

In the case of such a fixing device, in order to prevent a temperature rise in regions where paper does not pass, it is necessary to control the changing of the duty ratio of lighting of each of the heaters in accordance with the size of a transfer material to be passed. Hence, control in which the duty ratios of the two heaters are considered must be added to increase/decrease the lighting time period within the period of 500 msec. FIG. 6 illustrates lighting timings of the heaters when starting printing. Symbols tm and ts represent the lighting time periods of the main heater and the sub-heater, respectively. As shown in Table 1, the ratio of tm to ts is set to an optimum value in accordance with the size of the transfer material.

TABLE 1

| Width of paper | Ratio of lighting time periods (a:b) |
|---|---|
| A3, LDR | 3:2 |
| B4 | 4:1 |
| LGL, A4 | 5:0 |
| less than B5 | 5:0 (*) |

*: Interpaper distance is doubled

Since a large rush current is provided if the main heater and the sub-heater are simultaneously lit, it is desirable to light the two heaters by shifting the lighting timing by at least about 100 msec.

Accordingly, the lighting time period of the main heater is increased by making the start point of one period a reference point, and the lighting time period of the sub-heater is increased by making the end point of one period a reference point. Thus, overlap of lighting timings is prevented. Even if the main heater is lit with a duty ratio of 100%, the difference between the lighting timings of the two heaters does not become less than 100 msec from the ratio of lighting time periods shown in Table 1.

Figure 7:
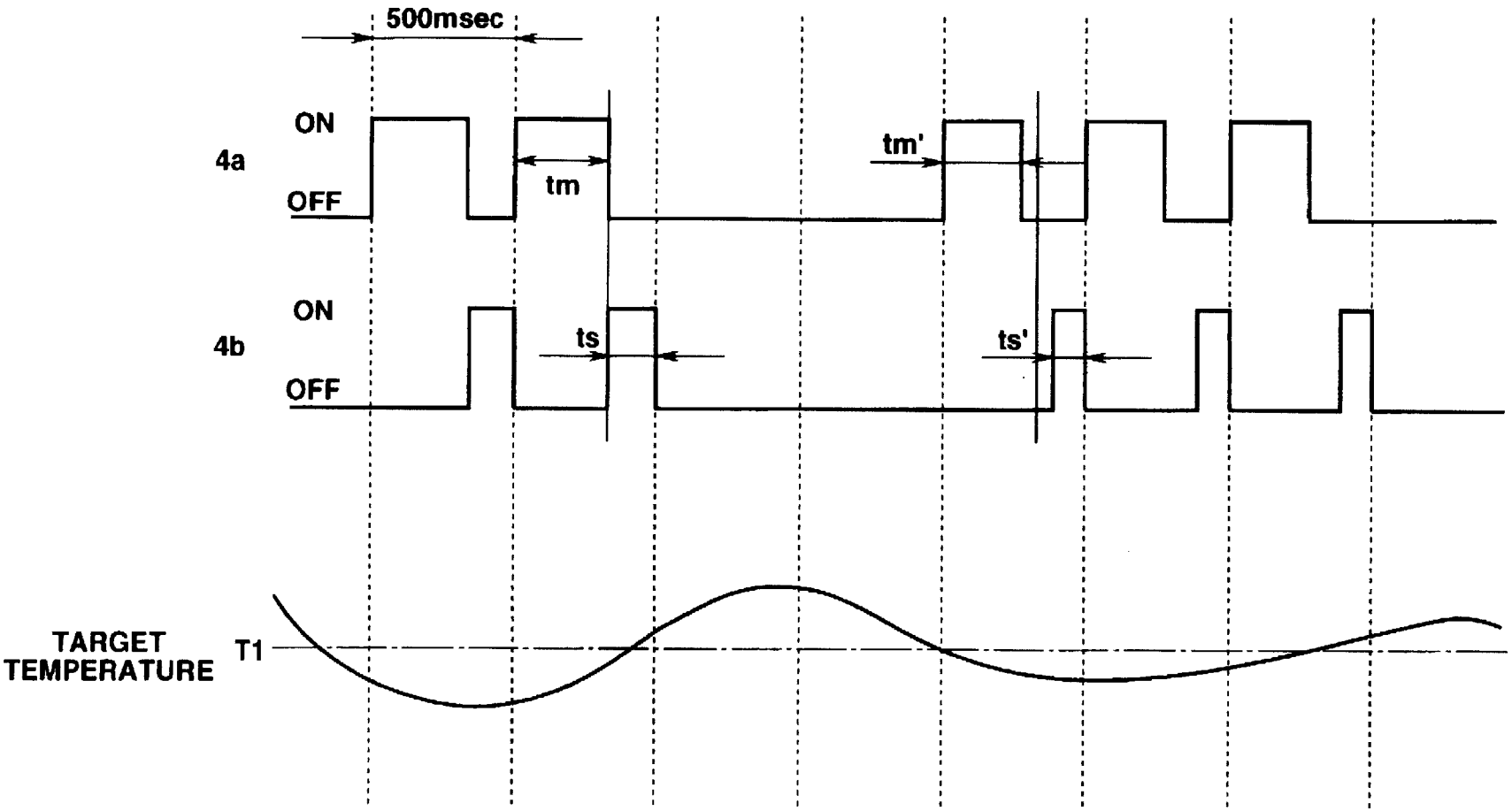
FIG. 7 is a diagram illustrating an example of temperature control for the two heaters shown in FIG. 4 at an initial stage of printing (control of a lighting time period of each of the heaters when the temperature of a fixing roller exceeds a target temperature T1)
Figure 8:
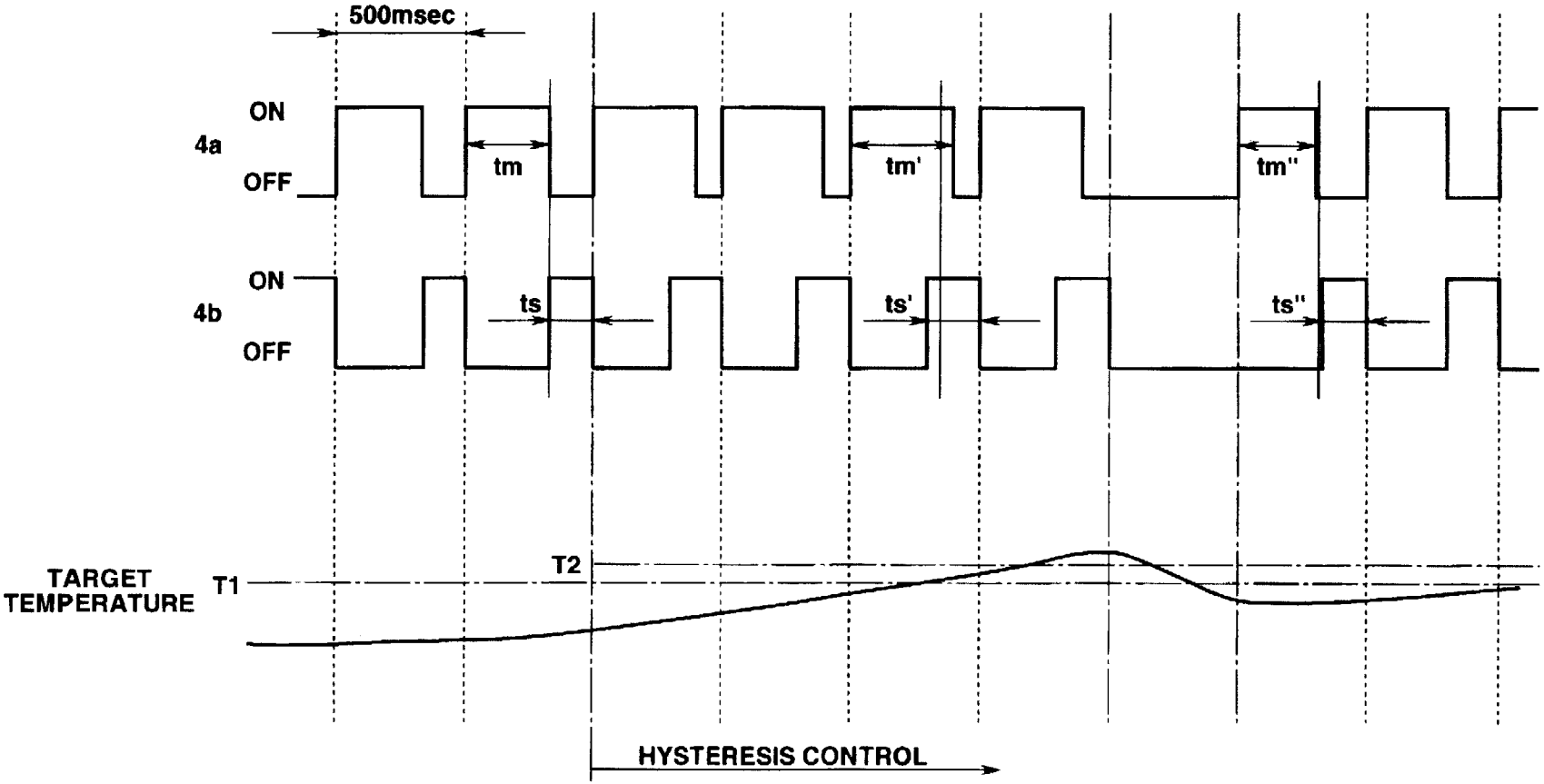
FIG. 8 is a diagram illustrating an example of hysteresis temperature control for the two heaters shown in FIG. 4 (control of a lighting time period of each of the heaters when the temperature of the fixing roller does not exceed the target temperature T1)

Next, a description will be provided of an actual control operation. When printing is performed with lighting timings shown in FIG. 6 and the power supplied to the heaters is sufficient to maintain the target temperature, the following control is performed. That is, as shown in FIG. 7, when the temperature T of the fixing roller exceeds T1, the heaters are turned off, and the on-time of each of the heaters within one period of 500 msec is reduced by 10% ($tm'=0.9 \cdot tm$, $ts'=0.9 \cdot ts$). When the temperature of the fixing roller becomes equal to or less than T1, the heaters are subjected to on/off lighting with the above-described lighting ratio. When repeating such control, the temperature of the fixing roller does not exceed, in some cases, T1 even by consecutive lighting with the period of 500 msec. If the temperature T of the fixing roler does not exceed T1 or continues to decrease even after consecutive lighting for 10 periods, as shown in FIG. 8, the on-time of each of the heaters within the period of 500 msec is increased by 5% ($tm'=1.05 \cdot tm$, $ts'=1.05 \cdot ts$), and the on/off control is continued.

Thereafter, the above-described hysteresis control is performed. That is, when the temperature T of the fixing roller exceeds T2, the heaters are turned off. When the temperature T of the fixing roller becomes equal to or lower than T1, on/off driving is repeated by reducing the on-time of each of the heaters by 10% ($tm''=0.9 \cdot tm'$, $ts''=0.9 \cdot ts'$). When the temperature T of the fixing roller does not exceed T1 even after consecutive lighting for 10 periods, on/off control is repeated by increasing the on-time by 5%.

Figure 9:
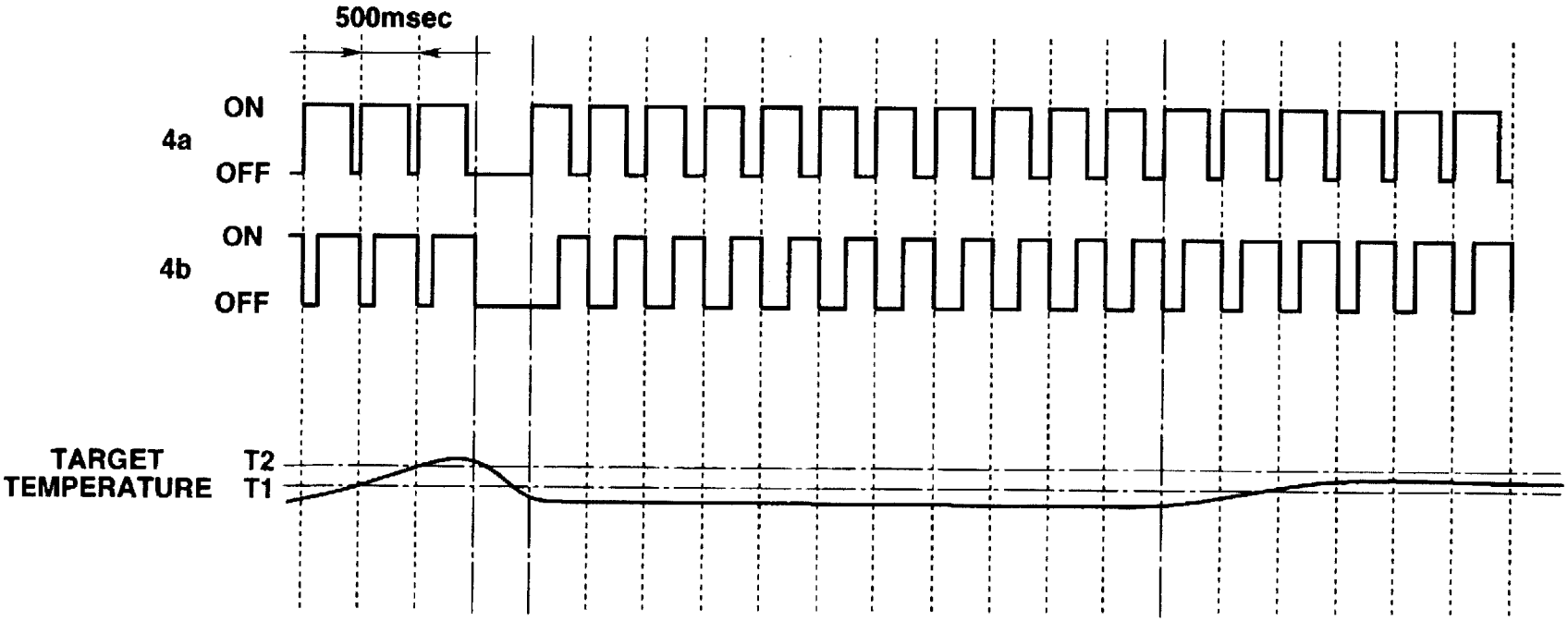
FIG. 9 is a diagram illustrating a stable temperature control state according to hysteresis temperature control in the second embodiment.

When the ambient temperature is low and the power supply voltage is at a lower specification limit, electric power is in some cases insufficient when starting printing. At that time, hysteresis control is performed from the start of printing. As shown in FIG. 9, by continuing this hysteresis control, the temperature of the fixing roller is stabilized in a range between T1 and T2, and the heat quantity supplied from the heater is balanced with the heat quantity transferred to paper and consumed by heat leakage. As a result, stable fixability is obtained.

Although in the above-described embodiments an explanation has been provided of a roller-type fixing device, the present invention is not limited to such a device. For example, as disclosed in Japanese Patent Laid-Open Application (Kokai) Nos. 63-313182 (1988), 2-157878 (1990), 4-44075-44083 (1992), the present invention may also be applied to a fixing device of a method in which a recording material is moved together with a heat-resistive film while making a heat source and the recording material in close contact with a surface and the other surface of the film, respectively, and thermal energy of the heat source is transferred to the recording material and a toner image on the recording material via the film.

As described above, by controlling heating means so that the ratio of the power supply time period is reduced for every heating period, the problem of a rush current from to power supply to the heating means during image formation is overcome. When the temperature of the heating means does not reach a set temperature within a predetermined time period, the ratio of the power supply time period is increased. Hence, the temperature of the heating means is appropriately maintained in the vicinity of the set temperature, so that an excellent fixing operation can be performed. Furthermore, since the substantial time period of power supply for the heating means is short, temperature changes in the surface of the roller can be reduced even if a thin roller having a small heat capacity is used.

In the above-described control, when the detected temperature does not reach a set temperature within a predetermined time period, a certain range is provided for the set temperature. When the detected temperature is within the range of the set temperature, switching of power supply to heating means is not performed. Hence, even in a state in which the heat quantity supplied to the heating means substantially equals the heat quantity transferred to paper and consumed by heat leakage, and therefore the temperature of the fixing roller is apt to change, it is possible to reduce temperature changes in the surface of the roller and to obtain stable fixability.

Third Embodiment

Next, a description will be provided of a third embodiment of the present invention in which a temperature decrease in a fixing roller can be prevented even if a fixing roller (heating rotating member) having a low heat capacity is used.

A fixing device according to the third embodiment has the same cross-sectional view as that shown in FIG. 10. Hence, a description thereof will be omitted.

This fixing device adopts center reference in which a recording material whose maximum passing width equals the A3 size (297 mm) is conveyed making the paper passing center of the device a reference position. Luminous intensity distribution of a heater 4 is also symmetrical with respect to the paper passing reference. The rated power of the heater 4 is 1000 W. A fixing roller 1 has a diameter of 30 mm and a thickness of 1.0 mm, and comprises a core bar 11, made of aluminum, coated with a releasing layer 12, made of PFA, on the surface thereof. A pressing roller 2 has a diameter of 30 mm and a hardness of 50°, and comprises a stainless-steel core bar 13 coated with an elastic layer 14, made of a silicone sponge, and also coated with a releasing layer 15, made of PFA, on the surface of the elastic layer 14. By applying a pressure of 150N to the pressing roller 2, a nip width of 4.5 mm can be provided between the fixing roller 1 and the pressing roller 2.

Next, a description will be provided of a method for controlling the heater. In the third embodiment, it is determined if paper is within the fixing nip based on a VSYNC signal for effecting vertical synchronization between image writing and paper. When paper is within the fixing nip, the heater is controlled so that the off-time of the heater is not longer than the time period of one revolution of the fixing roller 1. Whether paper is within the fixing nip can be easily calculated from the printing speed and the distance between the photosensitive member and the fixing nip.

Figure 13:
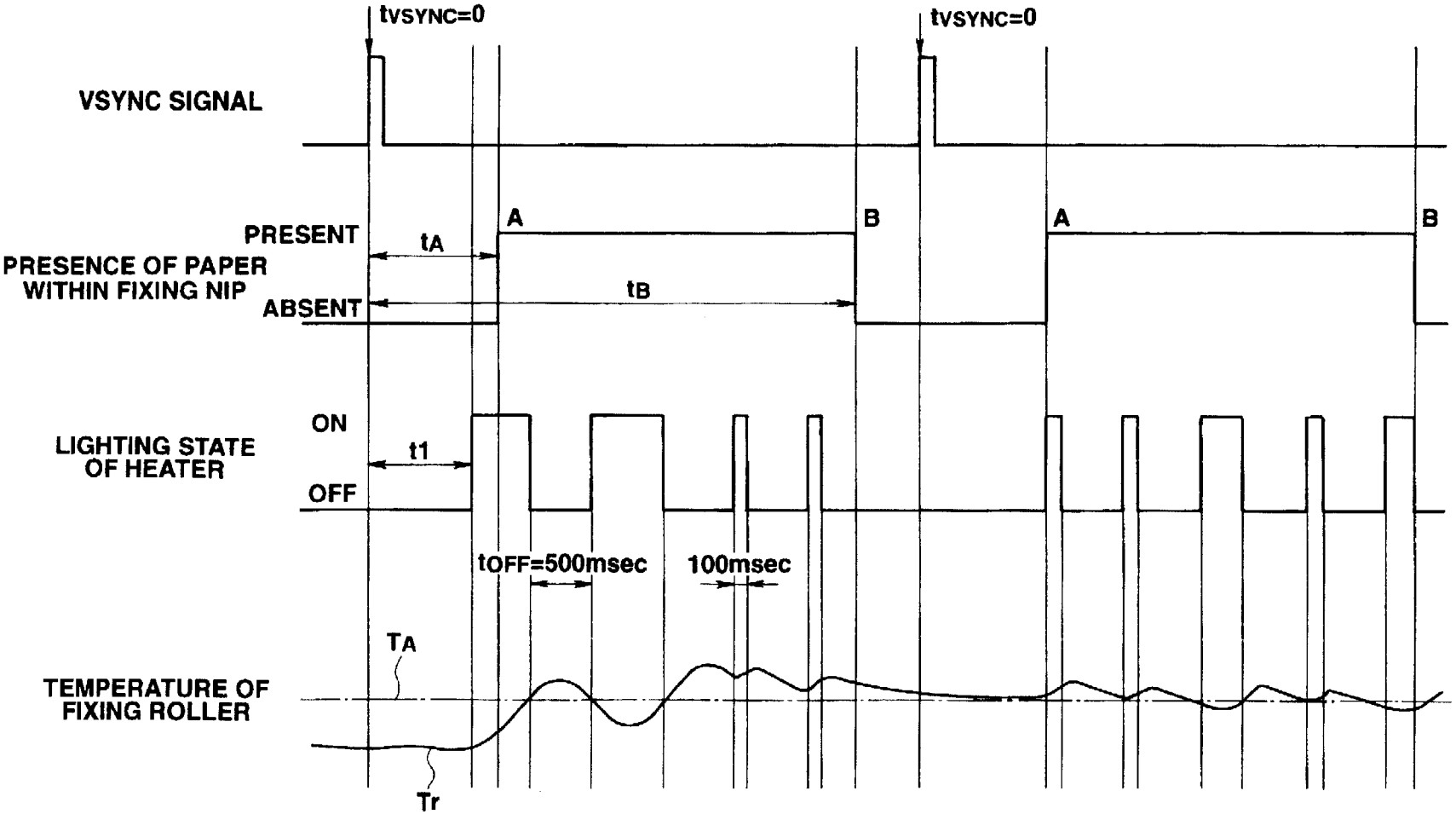
FIG. 13 is a diagram illustrating the relationships among the surface temperature of a fixing roller, an on/off state of a heater, timings of passage of paper through a fixing nip, and a VSYNC signal in temperature control according to a third embodiment of the present invention.
Figure 14:
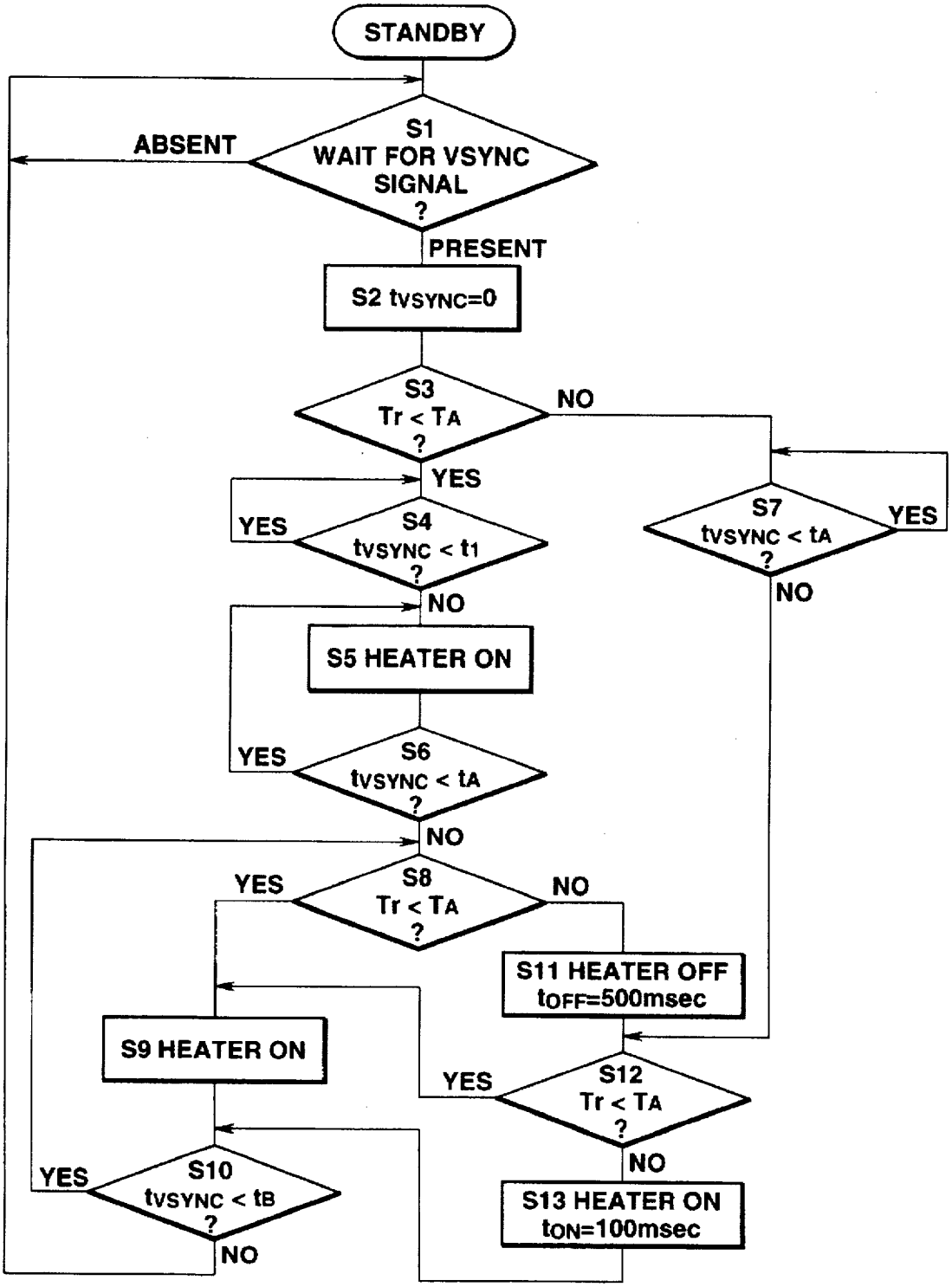
FIG. 14 is a flowchart illustrating temperature control in the third embodiment.

FIG. 13 illustrates the on/off timing of the heater, the timing of passage of paper through the fixing nip, and the surface temperature of the roller when performing printing on an A3-size recording material. FIG. 14 is a flowchart illustrating the control in the third embodiment. A description will now be provided of the control in the third embodiment with reference to this flowchart.

First, the timing of turning on the heater when the leading edge of paper enters the fixing nip will be described. In this embodiment, a timer counter $t_{VSYNC}$ is provided, and the on/off timing of the heater is obtained based on the value of this counter. In this timer counter, the number is incremented at a constant period independent of the control. Upon detection of a VSYNC signal (step S1), the counter is reset ($t_{VSYNC}=0$, step S2). The time periods until the time A where the leading edge of the paper enters the fixing nip, until the time B where the trailing edge of the paper leaves the fixing nip, and the time until the heater is turned on after the VSYNC signal has been output are represented by $t_A$, $t_B$, and $t_1$, respectively. The following control is performed with respect to the detected temperature $T_r$ of the fixing roller, and a target temperature $T_A$.

1. When $T_r<T_A$ ($t_{VSYNC}=0$) (Yes in step S3)

The heater is turned on (step S5) with the timing of $t_{VSYNC}=t_1$ (No in step S4). This timing of turning on the heater depends on the heat capacity of the fixing roller and the power of the heater. In the case of a thickness of about 1.0 mm as in the present embodiment, a sufficient effect has been confirmed with $t_1$=200 msec.

Thereafter, the following control is performed depending on the relationship between $T_r$ and $T_A$ from the timing A where the paper enters the fixing nip (No in step S6) to the timing B where the trailing edge of the paper leaves the fixing nip (No in step S10).

(a) When $T_r<T_A$ ($t_{VSYNC}=t_A$) (Yes in step S8)

(a-1) The heater is lit until the detected temperature $T_r$ of the fixing roller reaches the target temperature $T_A$ (step S9). When the temperature of the fixing roller has reached $T_A$ (No in step S8), the heater is turned off for a time period $t_{OFF}$ (step S11).

The heater-off time period $t_{OFF}$ must be shorter than the time period of one revolution of the fixing roller (628 msec). If the time period $t_{OFF}$ is longer than the time period of one revolution of the fixing roller, a failure in fixing due to an insufficient heat capacity of the thin roller occurs.

(a-2) When the temperature $T_r$ of the fixing roller after the time period $t_{OFF}$ is lower than the target temperature $T_A$ (Yes in step S12), the heater is turned on until the temperature of the fixing roller reaches the target temperature (step S9).

(a-3) When the temperature $T_r$ of the fixing roller after the time period $t_{OFF}$ is higher than the target temperature $T_A$ (No in step S12), the heater is lit for a time period $t_{ON}$ (=100 msec), and on/off control consisting of $t_{OFF}$, $t_{ON}$, $t_{OFF}$, . . . is repeated until the temperature $T_r$ becomes equal to or lower than $T_A$. Power is supplied to the heater after the lapse of the time period $t_{OFF}$ even if the detected temperature $T_r$ does not decrease to the target temperature $T_A$.

(b) When $T_r \geqq T_A$ ($t_{VSYNC}=t_A$) (No in step S8)

The control of (a-3) is performed from the start.

2. When $T_r \geqq T_A$ ($t_{VSYNC}=0$)

The heater is not turned on until the leading edge of the paper enters the fixing nip. The above-described control of (a-1)–(a-3) is performed depending on the relationship between $T_r$ and $T_A$ from the timing A where the leading edge of the paper enters the fixing nip (step S7) to the timing B where the trailing edge of the paper leaves the fixing nip (No in step S10).

By continuing the above-described control until the state of $t_{VSYNC}=T_B$ is provided, it is possible to provide stable fixability from the leading edge of the paper to the trailing edge of the paper.

In the present embodiment, $t_{OFF}$=500 msec and $t_{ON}$= 100 msec. However, it has been confirmed from experiments that any value smaller than the time period of one revolution of the fixing roller and greater than 0 may be adopted for the off-time of power supply. Hence, design having a wider degree of freedom can be effected depending on the heat capacity of the fixing roller, the printing speed, and the power of the heater. The value of $t_{ON}$ may be at least 60 msec and 50 msec for the frequencies of 50 Hz and 60 Hz, respectively, i.e., the time for three periods, of a commercial (AC) power supply connected via a triac 53*a*. However, since the heater sufficiently operates when the value of $t_{ON}$ equals at least 100 msec, it is desirable to set the minimum on-time to this value.

Fourth Embodiment

In temperature control according to a fourth embodiment of the present invention, the on/off time period of the heater is set to a value shorter than the time period of one revolution of the fixing roller is considered as one unit, and the time period of one unit is shorter than the time period of one revolution of the fixing roller.

Figure 15:
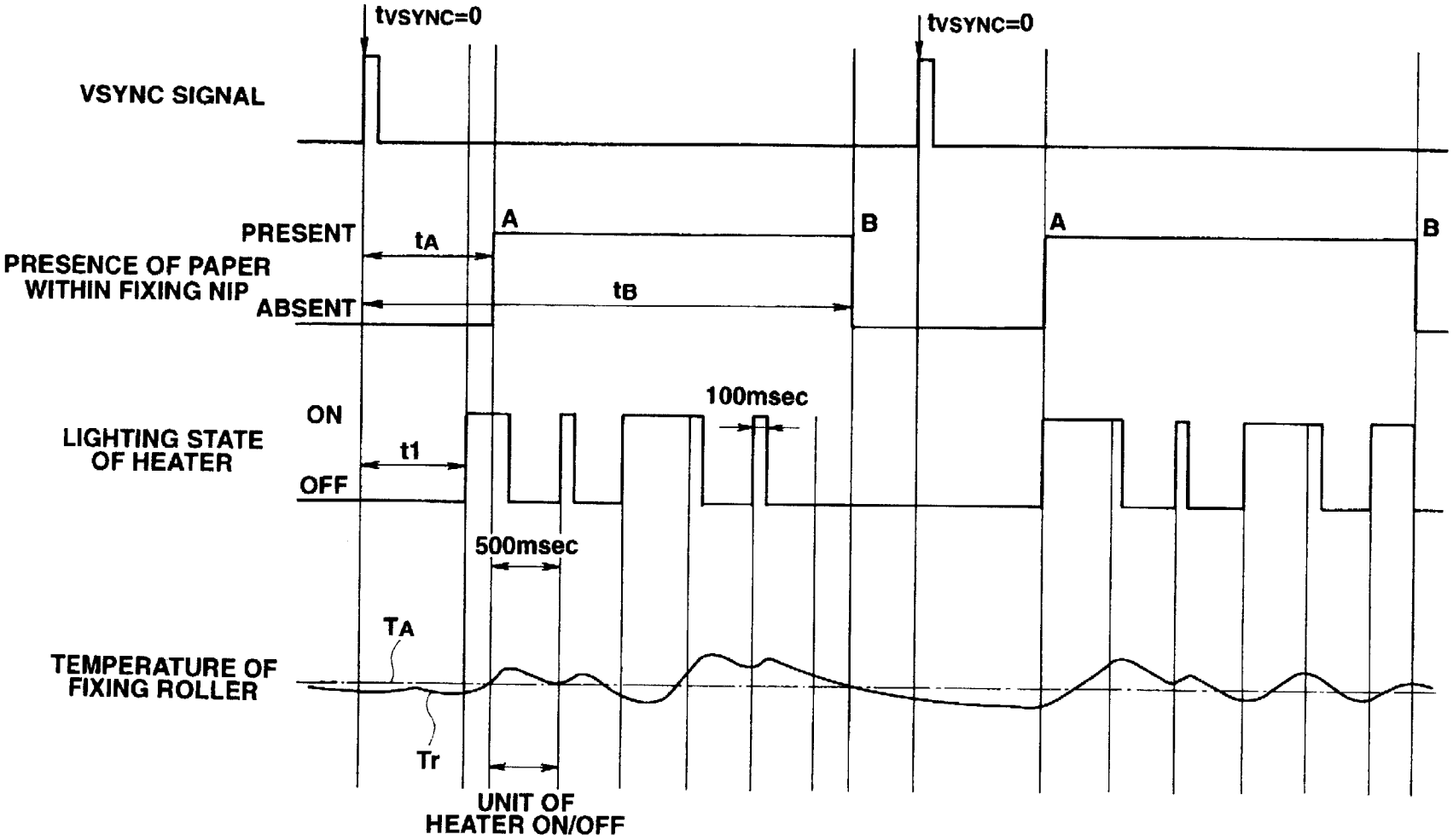
FIG. 15 is a diagram illustrating the relationships, when using a fundamental period equal to or less than one revolution of a fixing roller, among the surface temperature of the fixing roller when controlling a lighting time period of a heater within the fundamental period, an on/off state of the heater, timings of passage of paper through a fixing nip, and a VSYNC signal in temperature control according to a fourth embodiment of the present invention.

FIG. 15 illustrates the timing of passage of a paper in the fixing nip, the on/off state of the heater, and the temperature of the fixing roller when printing is performed on an A3-size recording material. A fixing device having the same configuration as in the above-described embodiment is used. The time period of one revolution of the fixing roller is 628 msec. The time period of one unit is assumed to be 500 msec. A3-size paper passes through the fixing nip in seconds at a printing speed of 150 mm/sec. Hence, 5.6 on/off units are included within that time period.

Figure 16:
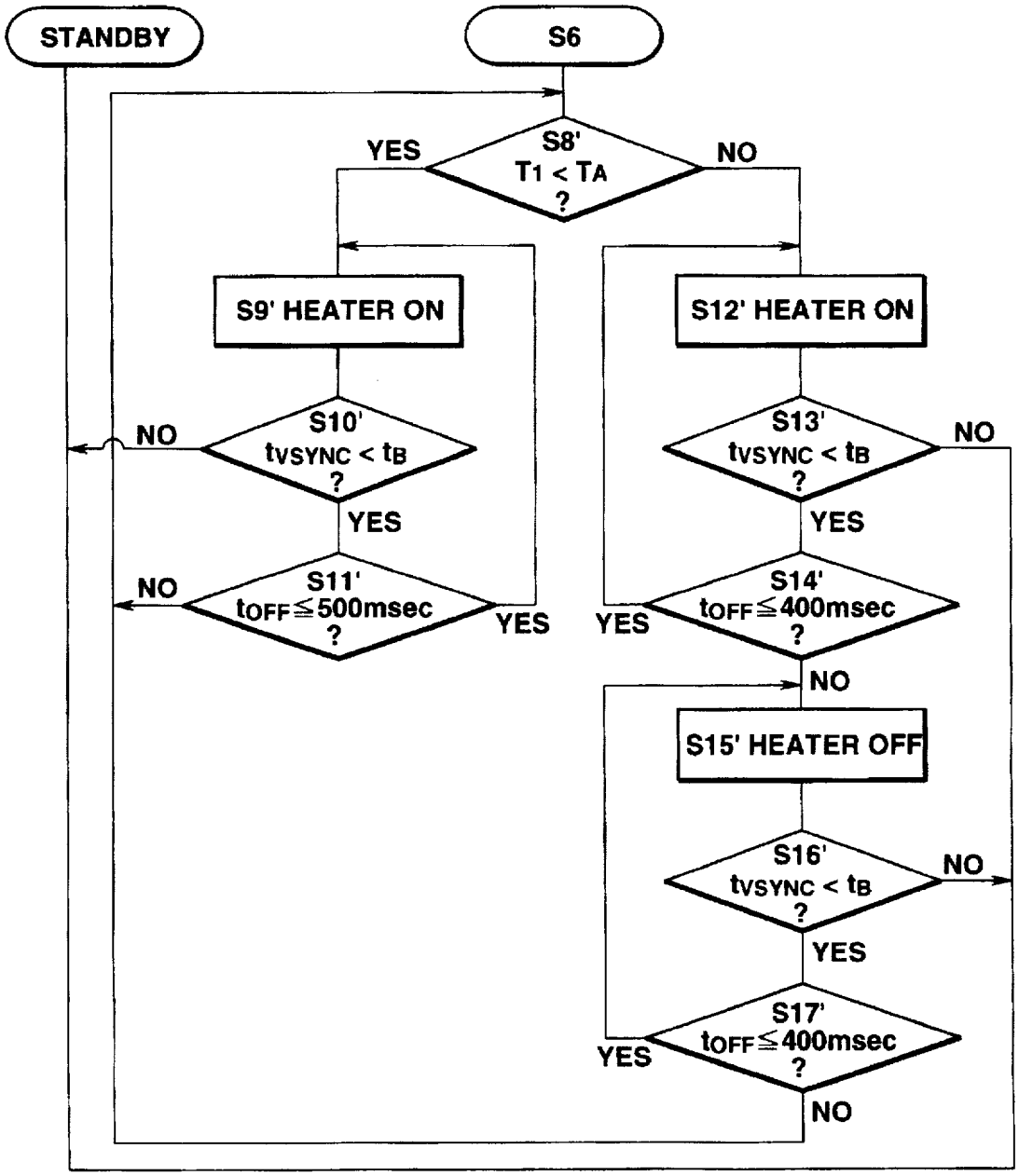
FIG. 16 is a flowchart illustrating temperature control in the fourth embodiment.

Also in the fourth embodiment, the same control as in the above-described embodiment is performed depending on the relationship between the target temperature $T_A$ and the detected temperature $T_r$ of the fixing roller. FIG. 16 is a flowchart illustrating processing procedures of the fourth embodiment. Since the processing procedures until paper enters the fixing nip (steps S1 through S7) is the same as in the processing shown in FIG. 14, the sequence after the paper enters the fixing nip will be described in detail.

When $t_{VSYNC}=t_A$ and $T_r<T_A$ (Yes in step S8'), the heater is turned on for the entire unit of 500 msec (steps S9'–S11'). When $T_r \geqq T_A$ (No in step S8'), the heater is turned on only for 100 msec within one unit of 500 msec (steps S12'–S14'). By performing the same control as in the above-described embodiment when $t_{VSYNC}=0$, the temperature of the fixing roller when fixing the leading edge of the paper can be maintained. By forcibly turning off the heater irrespective of the temperature $T_r$ of the fixing when the heater is on in the state of $t_{VSYNC}=t_B$ (steps S10' and S13'), overshoot after the paper leaves the fixing nip can be prevented. In such a control, the heater has only two lighting states for the target temperature $T_A$ while the paper passes through the fixing nip. Hence, by changing the control state at the trailing edge B of the paper (steps S10', S13'; and S16') by interrupt processing, it is possible to perform stable temperature control using simple software.

Figure 17:
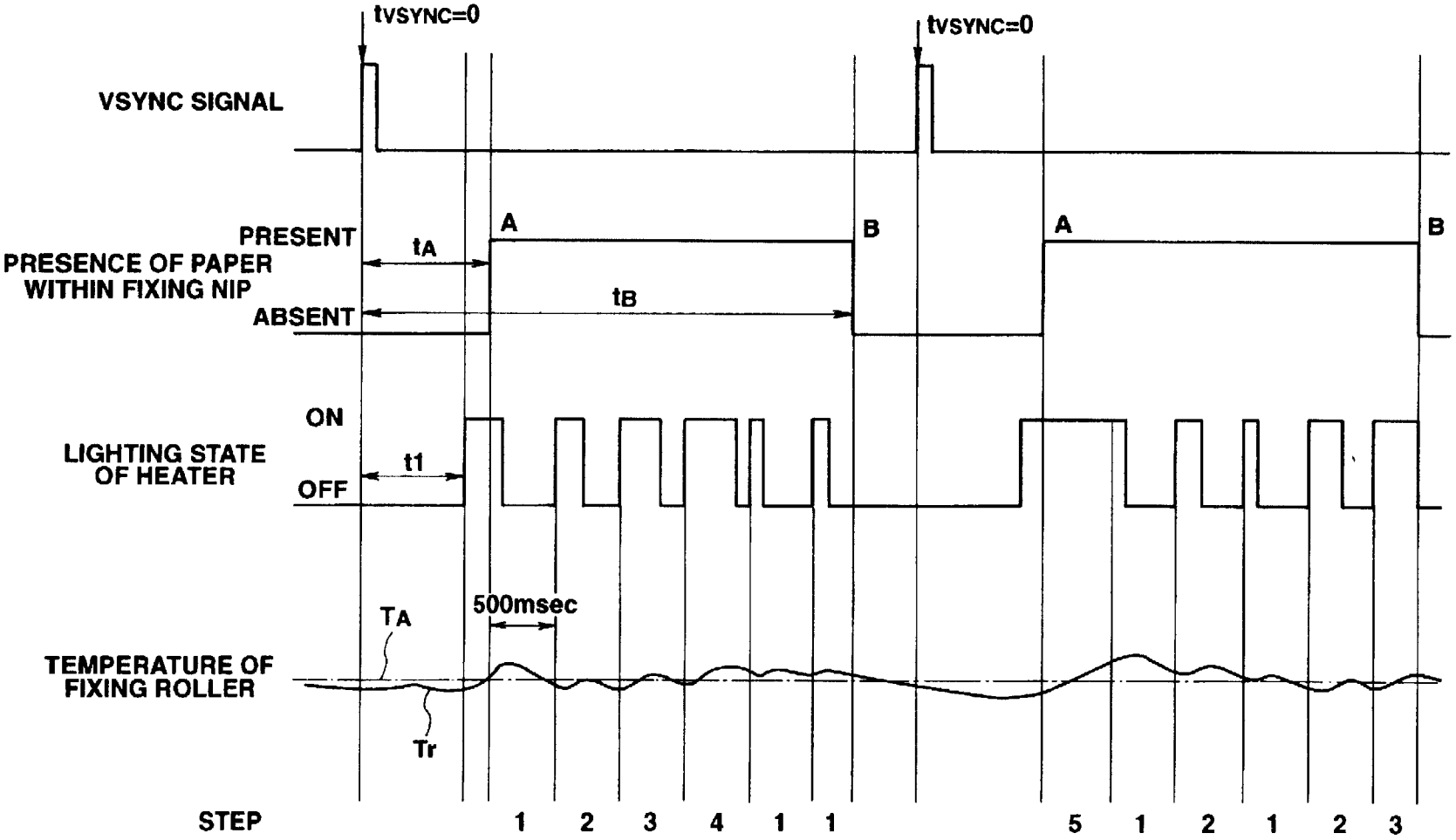
FIG. 17 is a diagram illustrating the relationships, when using a fundamental period equal to or less than one revolution of a fixing roller, among the surface temperature of the fixing roller when controlling a lighting time period of a heater within the fundamental period in five steps, an on/off state of the heater, timings of passage of paper through a fixing nip, a VSYNC signal, and heater lighting steps in temperature control according to a modification of the fourth embodiment.
Figure 18:
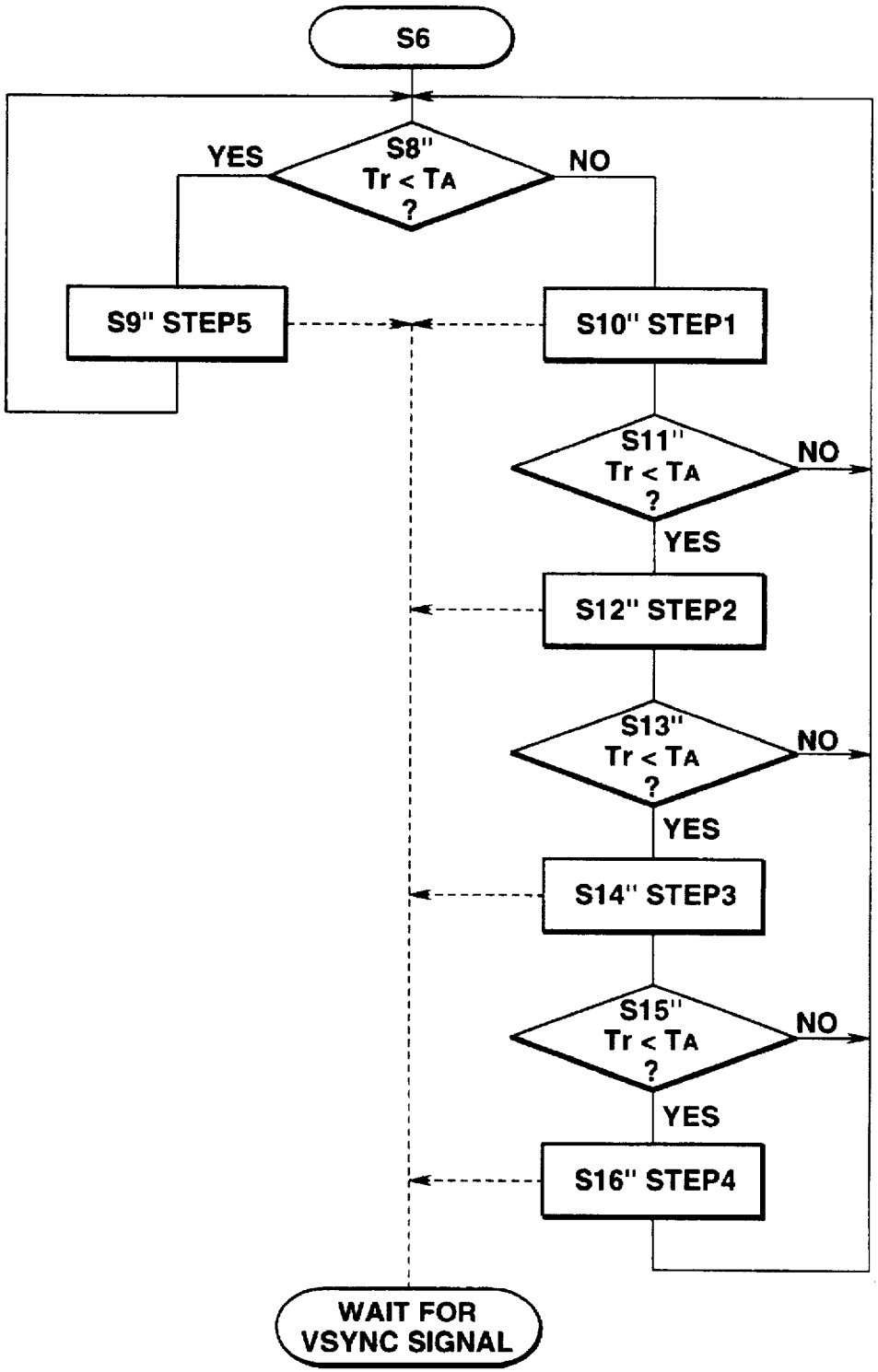
FIG. 18 is a flowchart illustrating temperature control in the modification of the fourth embodiment.

As a modification of the fourth embodiment, by setting the lighting time period of the heater within one unit to one of five steps shown in FIG. 19 instead of the two values of 100 msec and 500 msec, it is possible to perform finer control, and deal with a combination of a fixing roller and a heater in which temperature abruptly changes. A description will now be provided of a control method in such an approach. Control before paper enters the fixing nip is the same as in the above-described embodiment. The heater is driven as shown in FIG. 17 when the value of $t_{VSYNC}$ is between $t_A$ and $t_B$. FIG. 18 is a flowchart illustrating processing procedures at that time.

(1-1) When $T_r<T_A$ ($t_{VSYNC}=t_A$) (Yes in step S8"), the heater is lit according to step 5 ($t_{ON}$=500 msec), and the lighting is continued until the temperature of the fixing roller reaches the target temperature $t_A$ (steps S8" and S9").

(1-2) When $T_r \geqq T_A$ (No in step S8"), lighting according to step 1 ($t_{ON}$=100 msec) is continued (steps S10", and No in step S11").

(1-3) When $T_r<T_A$ (Yes in step S11"), the step number is increased from step 2 until the temperature of the fixing roller reaches the target temperature $T_r$ (step 2→step 3→step 4→step 5: step S12"–step S16"). When the temperature of the fixing roller reaches the target temperature, the processing of (1-2) is performed (step S8").

In each of steps S9", S10", S12", S14" and S16", comparison with the timer counter $t_{VSYNC}$ shown in FIG. 16 (steps S10', S13' and S16') is performed. When $t_{VSYNC}=t_B$, the process proceeds along paths indicated by broken lines, and the state of waiting for a VSYNC signal shown in FIG. 14 (step S1) is provided.

By changing the lighting time period of the heater in the above-described manner, it is possible to make the off-time of the heater within the time period of one revolution of the fixing roller to prevent abrupt temperature changes, and therefore to provide stable fixability.

As described above, even if a thin fixing roller having a small heat capacity is used, by making the maximum off-time of the heater smaller than the time period of one revolution of the fixing roller, it is possible to prevent an abrupt temperature drop in the fixing roller, as well as prevent an abrupt temperature rise by combining the off-time with the minimum on-time of the heater, and therefore to realize stable fixability over the entire surface of paper.

The individual components shown in outline or designated by blocks in the drawings are all well known in the fixing device arts and their specific construction and operation are not critical to the operation or the best mode for carrying out the invention.

While the present invention has been described with respect to what is presently considered to be the preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An image fixing device comprising:

a heating member for heating an image on a recording material;

a temperature detecting element for detecting a temperature of said heating member; and power supply control means for controlling power supply to said heating member, said power supply control means repeating alternately a turning-off period for turning off the power supply when the detected temperature is higher than a target temperature and a turning-on period for turning on the power supply when the detected temperature is lower than the target temperature, wherein a duty ratio of the power supply during a second turning-on period is smaller than that during a first turning-on period after the detected temperature initially reaches the target temperature.

2. A fixing device according to claim 1, wherein said power supply control means reduces the power supply duty ratio at a predetermined rate.

3. An image fixing device according to claim 1, wherein if the temperature detected by said temperature detecting element falls below the target temperature for a predetermined period of time during the turning-on period, said power supply control means gradually increases the power supply duty ratio.

4. A fixing device according to claim 3, wherein the rate of increase of the power supply duty ratio is smaller than the rate of decrease of the power supply duty ratio.

5. A fixing device according to claim 1, wherein said heating member comprises a heater, and a heating roller heated by said heater.

6. A fixing device comprising:

a heating rotating member;

temperature detection means for detecting a temperature of said heating rotating member; and power supply control means for controlling power supply to said heating rotating member so that the temperature detected by said temperature detection means is maintained at a set temperature, said power supply control means controlling the power supply such that a maximum power-supply-off time period is equal to or less than a time period required for one revolution of said heating rotating member.

7. A fixing device according to claim 6, wherein if a predetermined time period has elapsed after turning off power supply to said heating rotating member, said power supply control means turns on power supply to said heating rotating member.

8. A fixing device according to claim 6, wherein a period including a power-supply-on time period and a power-supply-off time period for said heating rotating member is shorter than a time period of one revolution of said heating rotating member.

9. A fixing device according to claim 6, wherein said heating rotating member comprises a heater, and a heating roller heated by said heater.

* * * * *

UNITED STATES PATENT AND TRADEMARK OFFICE

CERTIFICATE OF CORRECTION

PATENT NO. : 5,682,576
DATED : October 28, 1997
INVENTOR(S) : Hiroaki SAKAI, et al.

It is certified that error appears in the above-identified patent and that said Letters Patent is hereby corrected as shown below:

Title Page, [56] References Cited, Second Column:

delete "02157878" and insert therefor --2-157878--.
delete "04044075" and insert therefor --4-44075--.
delete "04044076" and insert therefor --4-44076--.
delete "04044077" and insert therefor --4-44077--.
delete "04044078" and insert therefor --4-44078--.
delete "04044079" and insert therefor --4-44079--.
delete "04044080" and insert therefor --4-44080--.
delete "04044081" and insert therefor --4-44081--.
delete "04044082" and insert therefor --4-44082--.
delete "04044083" and insert therefor --4-44083--.

Signed and Sealed this

Twenty-sixth Day of May, 1998

*Attest:*

*Attesting Officer*

BRUCE LEHMAN

*Commissioner of Patents and Trademarks*